US006062399A

United States Patent [19]

Henry et al.

[11] Patent Number: 6,062,399

[45] Date of Patent: May 16, 2000

[54] MERCHANDISE DISPLAY SYSTEM CONFIGURABLE FOR INSTALLATION ON A VARIETY OF MERCHANDISE DISPLAY FRAMES

[75] Inventors: Eric F. Henry, Rutherford; Lazzaro Pappagallo, Wayne, both of N.J.

[73] Assignee: HMG Worldwide In-Store Marketing, Inc., New York, N.Y.

[21] Appl. No.: 09/061,549

[22] Filed: Apr. 16, 1998

[51] Int. Cl.[7] ..... A47F 5/00

[52] U.S. Cl. ..... 211/103; 211/87.01; 211/189

[58] Field of Search ..... 211/103, 105.1, 211/105.3, 123, 87.01, 94.01, 189

[56] References Cited

U.S. PATENT DOCUMENTS

| | | | |
|---|---|---|---|
| 3,394,507 | 7/1968 | Doke | 211/103 X |
| 3,971,477 | 7/1976 | Bruderly et al. . | |
| 4,183,522 | 1/1980 | Killen | 211/105.1 X |
| 4,300,692 | 11/1981 | Moreno | 211/87.01 |
| 4,316,547 | 2/1982 | Varon | 211/105.1 |
| 4,550,893 | 11/1985 | Wiersema et al. | 211/103 X |
| 4,606,466 | 8/1986 | Fredrickson . | |
| 4,687,094 | 8/1987 | Allsop et al. | 211/88 X |
| 4,775,054 | 10/1988 | Dixon . | |
| 5,184,737 | 2/1993 | Hardy | 211/88 X |
| 5,303,830 | 4/1994 | Metcalf . | |
| 5,390,802 | 2/1995 | Pappagallo et al. . | |
| 5,443,167 | 8/1995 | Menaged et al. . | |
| 5,472,102 | 12/1995 | Clayton | 211/105.3 X |
| 5,499,727 | 3/1996 | Koch | 211/103 X |
| 5,509,541 | 4/1996 | Merl . | |
| 5,526,944 | 6/1996 | Merl | 211/103 X |
| 5,624,168 | 4/1997 | Licciardello, Sr. | 211/94.01 X |

*Primary Examiner*—Daniel P. Stodola
*Attorney, Agent, or Firm*—Cohen, Pontani, Lieberman & Pavane

[57] ABSTRACT

A merchandise display system for mounting on and to virtually any merchandise display frame, and in particular an existing gondola, having at least two horizontally spaced-apart mounting stanchions each having a plurality of apertures defined therein. The display system includes a universal mount with two universal brackets that are carried by a crossbar and that are selectively movable on and along the crossbar for alignment with the stanchion apertures. Once the universal brackets are so adjusted, the universal mount may be secured to the existing display frame by engaging the universal brackets with the aligned apertures. A frame assembly including a PEGBOARD® is then removably secured to the universal mount to complete the inventive merchandise display system. The configuration of the PEGBOARD® i.e., the size, spacing, and pattern of the holes in the PEGBOARD®, may be varied as desired to accommodate different merchandise display configurations.

10 Claims, 4 Drawing Sheets

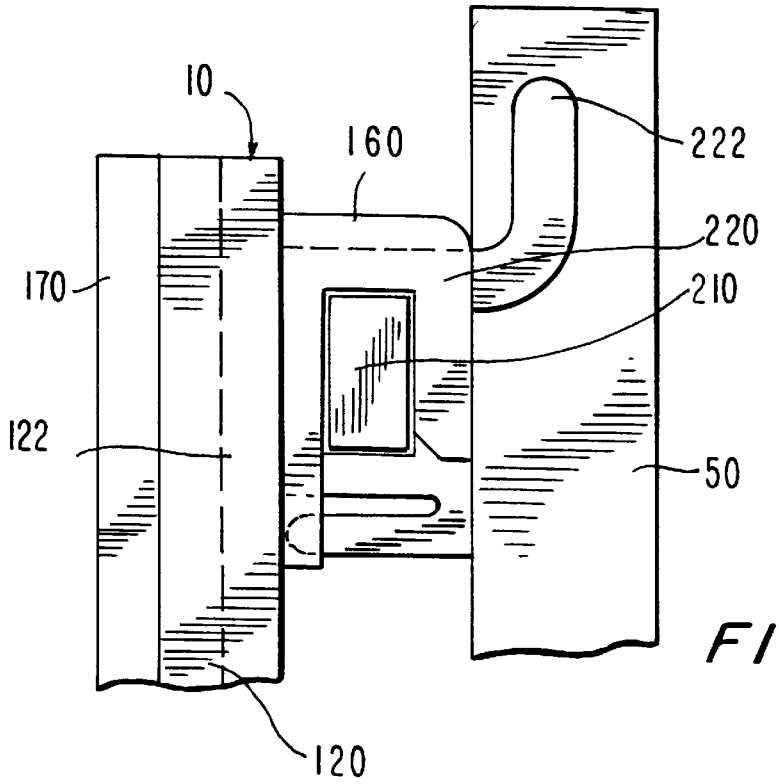
FIG. 5
FIG. 6
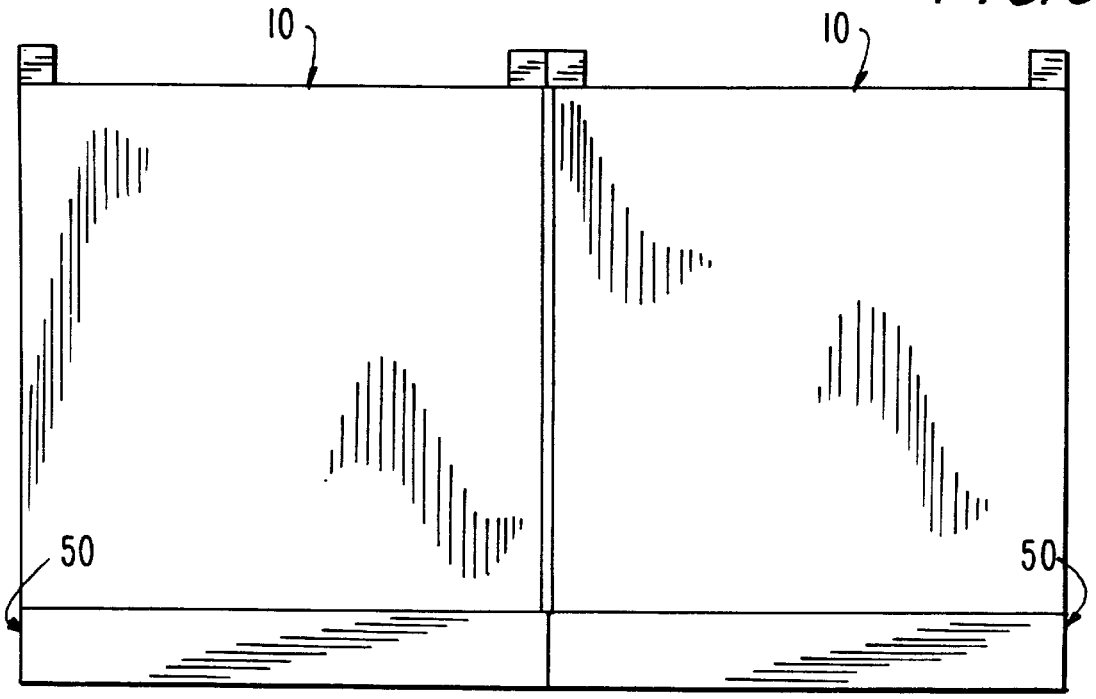

MERCHANDISE DISPLAY SYSTEM CONFIGURABLE FOR INSTALLATION ON A VARIETY OF MERCHANDISE DISPLAY FRAMES

BACKGROUND OF THE INVENTION

1. Field of the Invention

The present invention relates to a merchandise display system that is configurable for installation on a variety of merchandise display frames, and more particularly for installation on existing merchandise display gondolas.

2. Description of the Related Art

Supermarkets, department stores, and the like generally make a substantial investment in product display infrastructure such as frames, shelving and gondolas. Store owners have typically been able to stock and display their entire current inventory of products on the display infrastructure already installed in the store. Product displays may be changed or somewhat customized to accommodate particular products so long as such customization is permissible using the structural and dimensional specifics of the installed infrastructure, e.g. mounting holes, brackets, etc. In general, though, a store's installed display infrastructure is inflexible insofar as drastically altering product presentation and delivery and, as such, limits the store owner's options with respect to varying or altering the installed infrastructure.

As competition among various products increases, it has become more important to identify ways to distinguish one manufacturer's product from the rest of the field. One common approach is the use of eye-catching, unique product displays. It is therefore desirable for a store owner to be able to utilize existing display infrastructure that offers product manufacturers the flexibility to uniquely display and deliver their products. Unfortunately, currently available in-store display systems simply do not provide the desired flexibility that would permit the store owner to retrofit existing infrastructure to accommodate a variety of products as the needs of the store change, e.g. in response to requests from product manufacturers.

Reconfiguring existing merchandise display systems is a difficult, expensive and time-consuming task at best, and is generally beyond the capabilities of the typical store owner. It would therefore be advantageous to provide a merchandise display system to retrofit an existing display gondola, which can be installed by the store owner, without the use of tools, measuring or leveling devices.

A further disadvantage of existing product display gondolas is that a portion of the product display surface is taken up by supports (e.g. stanchions for mounting of shelf brackets), even though the supports may not be utilized. As the size of the display area directly relates to product sales, and hence to profits, it would therefore be advantageous to provide a merchandise display which maximizes the amount of product display area.

SUMMARY OF THE INVENTION

The present invention provides a novel and unobvious merchandise display system that may be installed on virtually any existing in-store display gondola to provide maximum usage and flexibility of a store's installed display infrastructure.

The inventive display system comprises at least one universal mount that is user-configurable for mounting to virtually any existing merchandise display gondola having at least two horizontally spaced-apart mounting stanchions in which are defined a plurality of apertures. The universal mount includes two universal brackets that are carried by a crossbar and that may be selectively moved on and along the crossbar for alignment with the stanchion apertures. The universal brackets have engagement tabs, which are inserted into the aligned apertures so as to removably attach the universal mount to the existing display gondola. The crossbar is provided with means, such as end caps or ridges, for maintaining the universal brackets thereon The present invention further comprises a frame assembly having a frame and a PEGBOARD®. The frame has a back side, which faces the existing gondola, and a front side having the PEGBOARD® affixed thereto. The frame includes top and bottom horizontal frame members, which are affixed between, and perpendicular to, two vertical frame members, so as to form an essentially rectangular structure. Intermediate horizontal frame members may be similarly affixed to the vertical frame members, as required, dependant upon the size and weight of the frame assembly. At least one frame attachment bracket is slidably engaged in a slot defined in the back side of each vertical frame member, so as to selectively move along the vertical frame member for alignment with each universal mount. The frame attachment bracket has an inverted u-shaped mounting arm, which removably engages the universal mount crossbar, thereby securing the frame assembly to the existing display gondola. Once the frame attachment brackets are engaged on the crossbars, the frame assembly is then lowered until the bottom horizontal frame member rests on the existing gondola's bottom platform.

In a typical store display infrastructure, a plurality of the inventive display systems are mounted next to and abutting one another so as to produce a virtually continuous PEGBOARD® surface, thereby maximizing the displayable area. The configuration of the PEGBOARD®, i.e. the size, spacing, and pattern of the holes in the PEGBOARD®, may be varied as desired to accommodate different merchandise display configurations. Accessories, such as header extensions for display of signage and lighting, and vertical standards for attachment of shelving, racks and bins, are further advantageous features of the present invention.

The present invention therefore provides a merchandise display system that is flexible enough to accommodate myriad display and presentation configurations and that may be easily installed on virtually any existing display gondola, thus obviating the need to install customized displays or to replace existing display frames.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views:

FIG. 5 is a side view taken along the lines 5–5 in FIG. 1; and

FIG. 6 is a front view of two merchandise display systems installed adjacent one another and constructed in accordance with the present invention.

DETAILED DESCRIPTION OF THE PRESENTLY PREFERRED EMBODIMENTS

Figure 1:
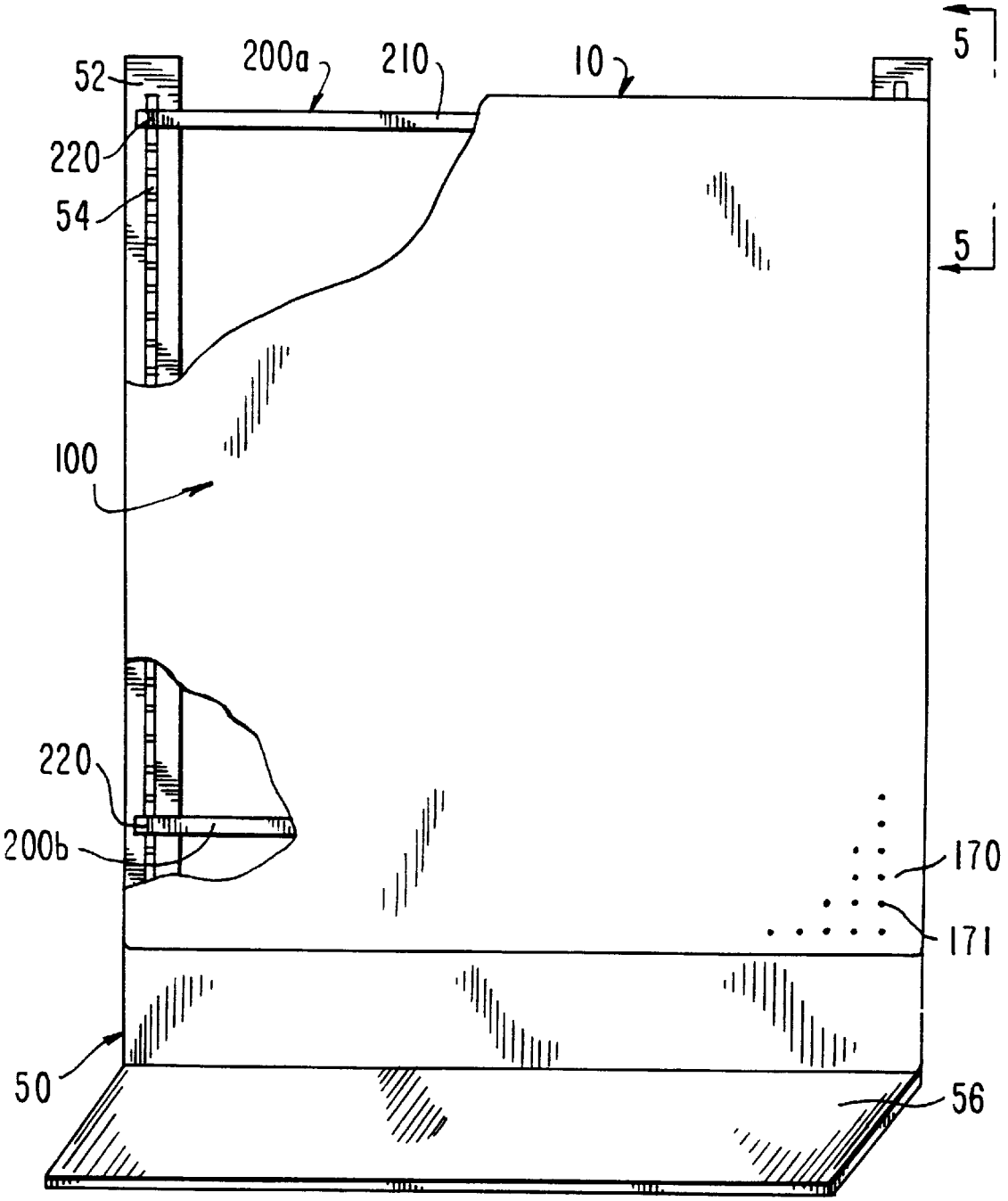
FIG. 1 is a front view of a merchandise display system, shown in partial cut-away, in accordance with the present invention and installed on a merchandise display frame.
Figure 2:
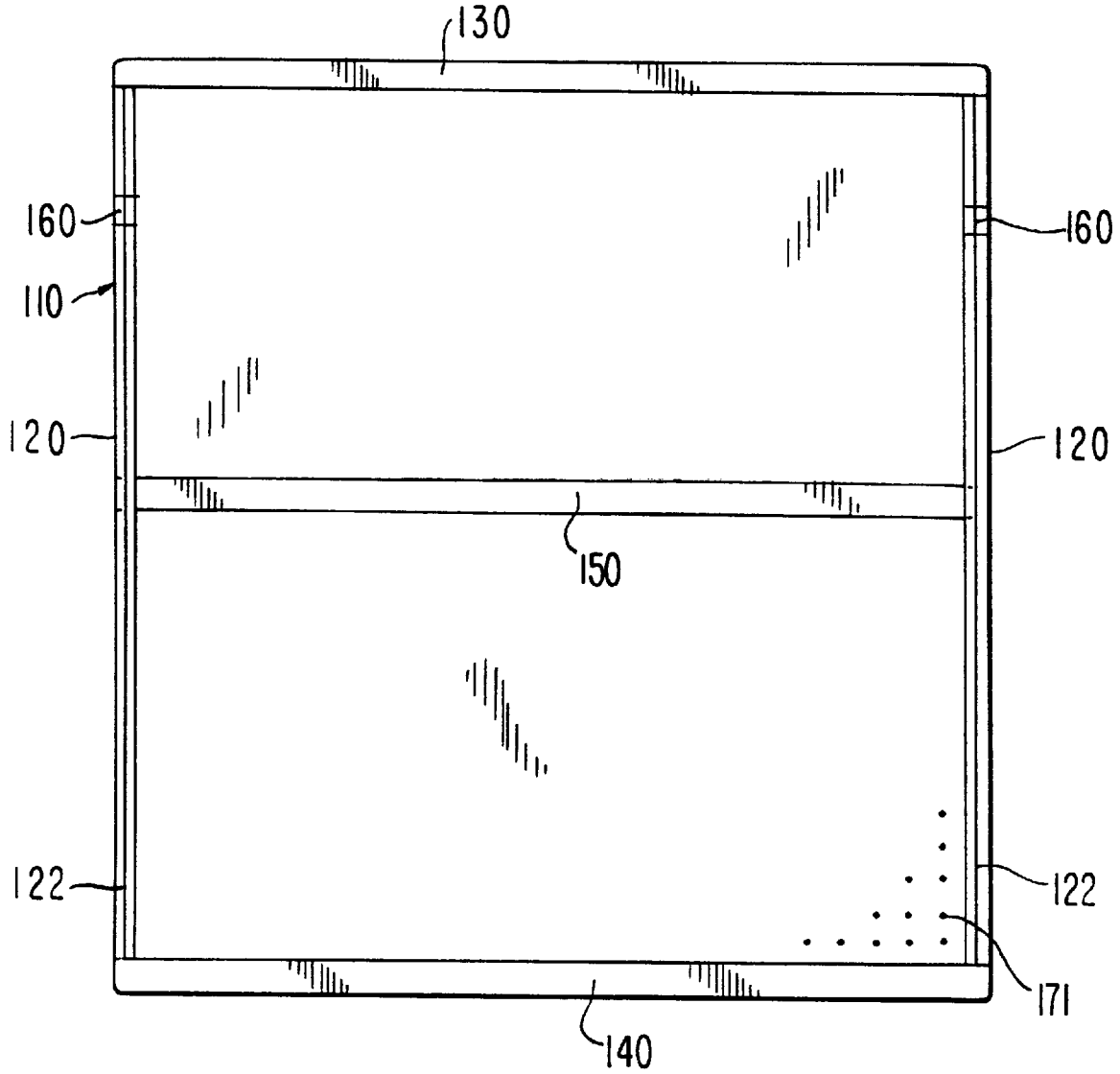
FIG. 2 is a rear view of a frame assembly of the merchandise display system of FIG. 1.

FIGS. 1 and 2 depict a merchandise display system 10 constructed in accordance with the present invention and installed on an existing display gondola 50. The gondola 50 has two horizontally spaced-apart mounting stanchions 52, with a plurality of apertures 54 defined therein. The gondola 50 further has a bottom platform 56. The inventive merchandise display system 10 includes a frame assembly 100 comprising a PEGBOARD® 170 mounted to a frame 110. PEGBOARD® 170 is a board having a plurality of spaced holes which are adapted to receive a plurality of different support devices. The frame 110 includes two vertical frame members 120, a top horizontal frame member 130, a bottom horizontal frame member 140, and an intermediate horizontal frame member 150, all connected together to give the frame 110 a generally rectangular shape. The intermediate horizontal frame member 150 may be connected between the vertical frame members 120 substantially perpendicular thereto at a location approximately mid-way between the top and bottom frame members 130, 140. Depending on the size of the frame assembly 100, additional intermediate horizontal frame members 150 may be provided as a matter of routine design choice to provide additional structural rigidity to the frame assembly 100. In addition, the intermediate horizontal frame member 150 may be connected between the vertical frame members 120 at any point relative to the top and bottom frame members 130, 140, i.e., it need not be connected midway between the top and bottom frame members 130, 140. The frame assembly 100 has a back side, which faces the existing gondola 50, and a front side to which the PEGBOARD® 170 is affixed. The terms vertical and horizontal, as used herein, are intended to provide an orientational reference with respect to the drawings, and do not define or otherwise limit the display system of the present invention which may be constructed and arranged in a variety of orientations, such as a parallelogram or trapezoid.

Figure 3:
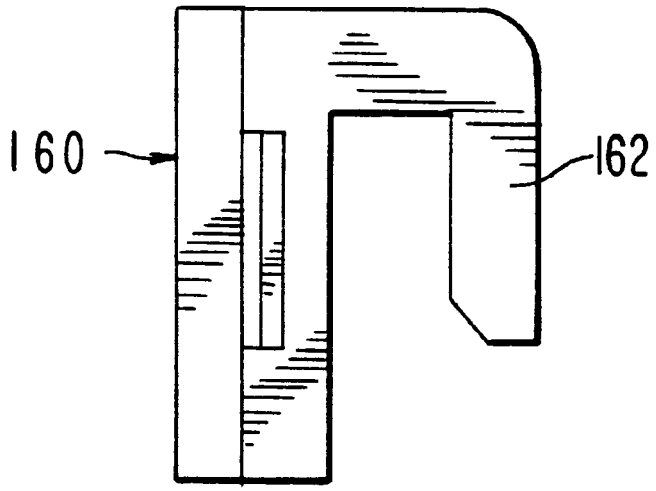
FIG. 3 is a side view of a frame attachment bracket of the merchandise display system of FIG. 1.

The frame assembly 100 further includes at least one frame attachment bracket 160 slidably engaged in a slot 122 defined in the back side of each vertical frame member 120. In a preferred embodiment, two frame attachment brackets 160 are provided, one in each of the two vertical frame members 120. A frame attachment bracket 160 may additionally be provided in the slot 122 proximate each connection between the bottom horizontal frame member 140 and the vertical frame member 120. The frame attachment bracket 160 includes an inverted u-shaped mounting arm 162 (see FIG. 3) configured to releasably engage a universal mount 200*a* as described in more detail herein below.

The PEGBOARD® 170 has a plurality of holes 171 defined therethrough and is provided on the front side of the frame assembly 100. The PEGBOARD® 170 may be configured in virtually any way, i.e., with the holes spaced apart from each other in any suitable spacing or configuration, as desired. In a preferred embodiment, the PEGBOARD® holes are spaced apart on one-half inch centers.

Figure 4:
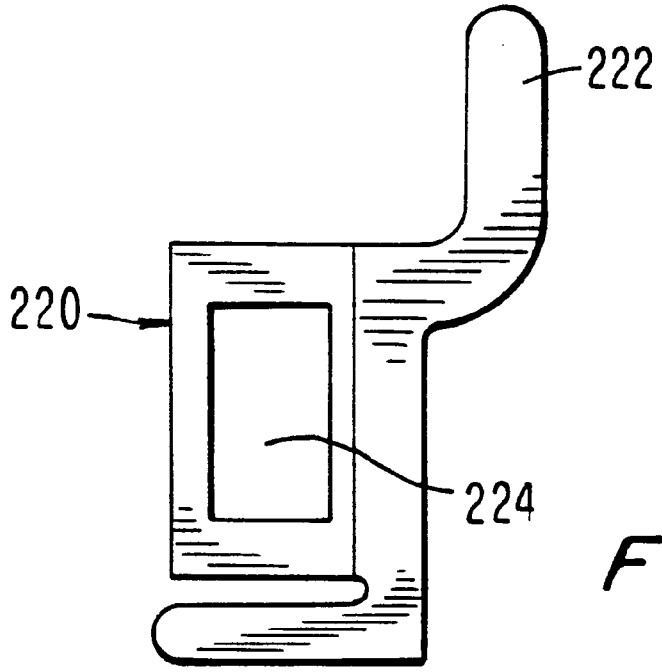
FIG. 4 is a side view of a universal bracket of the merchandise display system of FIG.

The inventive merchandise display system 10 further comprises a universal mount 200*a* having a generally horizontal cross-bar 210 and two universal brackets 220 (see FIG. 4) mounted slidably thereon for selective movement on and along the cross-bar 210. Each of the universal brackets 220 may be positioned anywhere along the cross-bar 210, thus permitting the universal mount 200*a* to be mounted to virtually any existing display frame 50, without regard to the spacing between the mounting stanchions 52 of the existing frame 50. The universal bracket 220 includes an engagement tab 222 that is sized and shaped to engage an aperture 54 defined in the stanchion 52. An aperture 224 defined in the universal bracket 220 is sized and shaped to permit the universal bracket 220 to move freely on and along the crossbar 210.

The cross-bar 210 can be configured from two sections arranged in a telescoping fashion so as to be adjustable in length.

The inventive merchandise display system 10 may be installed on virtually any display frame 50 and thus permits store owners to retrofit their existing display infrastructure as needed to accommodate new product lines and display configurations. Product manufacturers also benefit from the inventive merchandise display system 10 in that customized displays are now possible without the added expense of installing a completely new display infrastructure.

To install the inventive merchandise display system 10 on an existing display frame 50, the universal brackets 220 are slidably positioned on the cross-bar 210 to align with apertures 54 located on separate stanchions 52. The engagement tab 222 of each of the universal brackets 220 is inserted into the stanchion aperture 54 with which it is aligned, thus removably securing the universal mount 200*a* to the display frame 50, preferably proximate the top of the display frame 50.

The frame assembly 100 is then removably installed on the existing display frame 50 by engaging the mounting arm 162 of the frame attachment bracket 160 with the crossbar 210, as depicted in FIG. 5. A second universal mount 200*b* may also be provided and positioned near the bottom of the display frame 50 if additional support for the frame assembly 100 is desired. See FIG. 1. In this alternative embodiment, additional frame attachment brackets 160 are provided on the two vertical frame members 120 to engage the crossbar 210 of the second universal mount 200*b*. The frame assembly 100 is then lowered so that the bottom horizontal member 140 member rests on the bottom platform 56 of the existing gondola 50.

The slidable universal brackets 220 and the slidable frame attachment brackets 160, combined with the selectively configurable PEGBOARD® 170, provide a merchandise display system 10 that may be adapted to mount to virtually any existing display frame 50 and thus obviates the need to replace already installed displays or to install additional customized displays for particular products.

A plurality of merchandise display systems 10 configured in accordance with the present invention may be installed adjacent to each other, as for example depicted in FIG. 6, providing a continuous pegboard surface without the unsightly gaps and spaces between adjacent PEGBOARD® 170 as are typically present. Consequently, displayable area is maximized, and filler panels and other decorative structures are no longer required to provide an aesthetically pleasing merchandise display system.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps, which perform substantially the same function in substantially the same way to achieve the same results, are within the scope of the invention. It is the intention, therefore, to be limited only as indicated by the scope of the claims appended hereto.

What is claimed is:

1. A merchandise display system for mounting to a display frame having two horizontally spaced-apart mounting stanchions each with a plurality of apertures defined therein, said display system comprising:

a universal mount adapted to be releasably mounted to the display frame and comprising a cross-bar and two universal brackets slidably carried by said cross-bar for movement thereon and therealong, each of said universal brackets including an element sized and shaped to releasably engage an aperture in one of the mounting stanchions; and a frame assembly comprising two side frame assembly members each having a longitudinally running slot therein, a board having a plurality of spaced holes, and a first pair of frame attachment brackets, each bracket of said first pair of frame attachment brackets being slidably engaged in the slot of a respective one of the two side frame assembly members, said first pair of frame attachment brackets being sized and shaped to releasably engage said universal mount so as to removably secure said frame assembly to the display frame, said frame assembly being releasably mountable to said cross-bar.

2. The merchandise display of claim 1, wherein each of said universal brackets comprises an engagement tab sized and shaped to releasably engage a stanchion aperture.

3. The merchandise display system of claim 1, wherein said frame assembly further comprises:

a top frame member extending between said two side frame assembly members at a top end thereof; and a bottom frame member extending between said two side frame assembly members at a bottom end thereof.

4. The merchandise display system of claim 3, wherein each of said frame attachment brackets comprises a mounting arm sized and shaped to releasably engage said universal mount.

5. The merchandise display system of claim 3, wherein said frame assembly further comprises an intermediate frame member connected to said two side frame assembly members and oriented substantially parallel with said top and bottom members.

6. The merchandise display system of claim 3, further comprising an additional universal mount adapted to be releasably mounted to the display frame, said additional universal mount comprising a cross-bar and two universal brackets slidably carried by said cross-bar and selectively movable thereon and therealong, each of said universal brackets being sized and shaped to releasably engage an aperture in one of the mounting stanchions.

7. The merchandise display system of claim 6, wherein said frame assembly further comprises a second pair of frame attachment brackets, each bracket of said second pair of frame attachment brackets being slidably engaged in the slot of a respective one of the two side frame members, said second pair of frame attachment brackets being sized and shaped to releasably engage said second universal mount so as to removably secure said frame assembly to the display frame.

8. The merchandise display system of claim 3, wherein said top frame member and said bottom frame member are arranged horizontally.

9. The merchandise display system of claim 8, wherein said side frame members are arranged vertically so as to form a substantially rectangular frame with said top and said bottom frame members.

10. The merchandise display system of claim 1, wherein said cross-bar is comprised of two sections wherein one section slides within the other section in a telescoping fashion so that said cross-bar is adjustable in length.

* * * * *